United States Patent [19]

Nowroski et al.

[11] 4,056,085

[45] Nov. 1, 1977

[54] ENGINE POSITIVE CRANKCASE VENTILATION VALVE ASSEMBLY

[75] Inventors: Alvin P. Nowroski, Livonia; Lyman V. Root, Dearborn, both of Mich.

[73] Assignee: Ford Motor Company, Dearborn, Mich.

[21] Appl. No.: 697,497

[22] Filed: June 18, 1976

[51] Int. Cl.[2] ..... F02M 25/06; F02F 9/00

[52] U.S. Cl. ..... 123/119 B; 123/119 EE

[58] Field of Search ..... 123/119 B, 119 EE

[56] References Cited

U.S. PATENT DOCUMENTS

| | | | |
|---|---|---|---|
| 2,407,178 | 9/1940 | Roos | 123/119 B |
| 2,423,592 | 7/1947 | Foster | 123/119 B |
| 2,639,701 | 5/1953 | Bales | 123/119 B |
| 2,829,629 | 4/1958 | Badertscher et al. | 123/119 B |
| 2,853,986 | 9/1958 | Kolbe | 123/119 B |
| 3,111,138 | 11/1963 | Humphreys | 123/119 R |
| 3,308,798 | 3/1967 | Snider | 123/119 B |
| 3,581,721 | 6/1971 | Horiuchi | 123/119 B |
| 3,645,242 | 2/1972 | Horiuchi | 123/119 B |
| 3,646,925 | 3/1972 | Eshelman | 123/119 B |
| 3,730,160 | 5/1963 | Hughes | 123/119 B |
| 3,753,304 | 8/1973 | Hughes | 123/119 B |
| 3,778,038 | 12/1973 | Eversole et al. | 123/119 EE |
| 3,868,936 | 3/1975 | Rivere | 123/119 EE |

*Primary Examiner*—Wendell E. Burns

*Attorney, Agent, or Firm*—Robert E. McCollum; Keith L. Zerschling

[57] ABSTRACT

An automotive type internal combustion engine has a positive crankcase ventilation (PCV) valve metering the flow of engine blow-by gases and fumes from the engine crankcase to the intake manifold, the valve having a sonic flow passage providing flow over the entire part throttle operating range of the vehicle to provide a precise flow and predictable calibration of the flow.

6 Claims, 5 Drawing Figures

FIG. 3
PRIOR ART
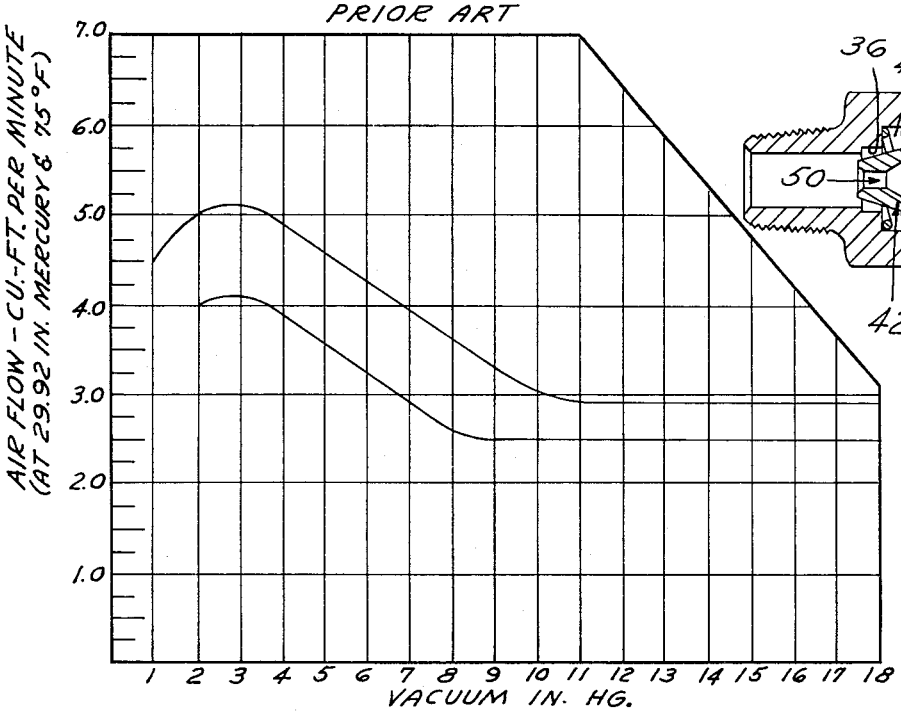
FIG. 2
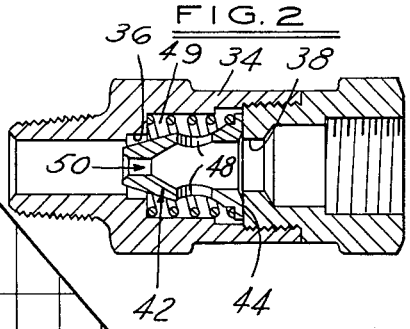
FIG. 1
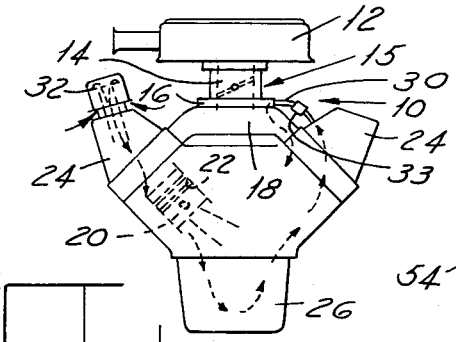
FIG. 4
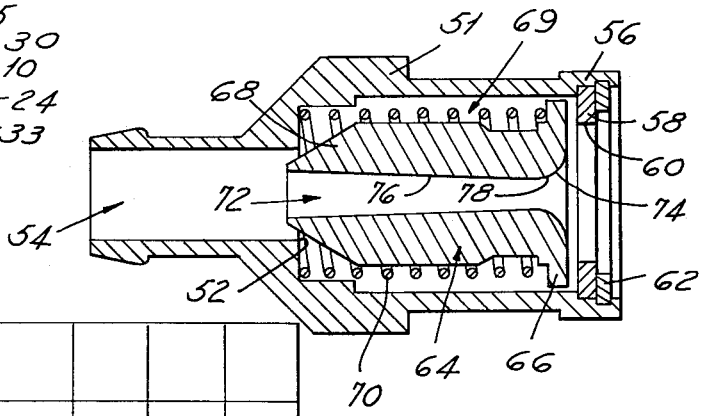
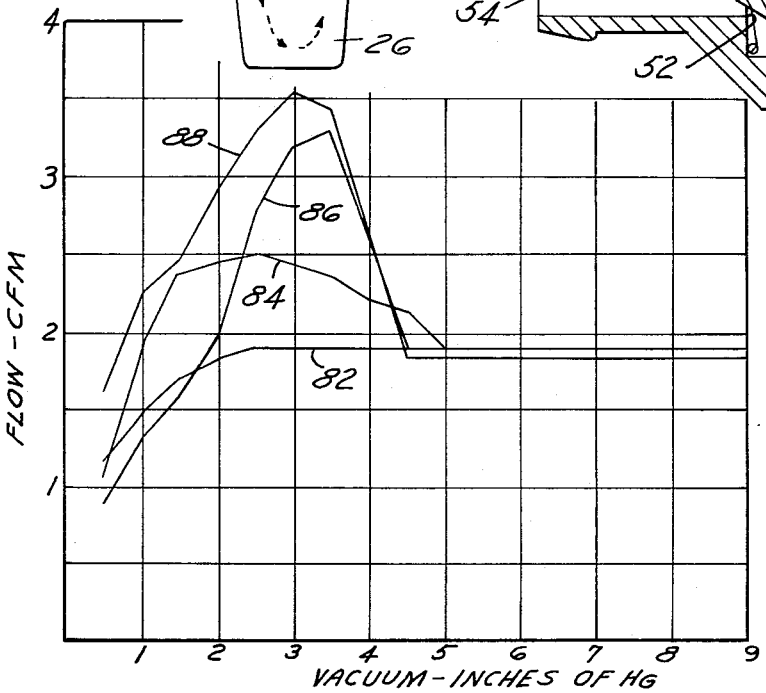
FIG. 5

ENGINE POSITIVE CRANKCASE VENTILATION VALVE ASSEMBLY

This invention relates in general to a positive crankcase ventilation (PCV) valve assembly for use in an internal combustion engine to recirculate engine blow-by gases and vapors back into the engine. More particularly, it relates to a sonic flow valve assembly that provides more precise metering than known constructions.

Engine PCV valves are well known for controlling the flow of blow-by gases and vapors back into the engine in a continuous, metered manner so as not to unduly affect the air/fuel mixture ratio, while at the same time getting rid of the blow-by. The known devices usually consist of a somewhat pear-shaped "jiggle" pin reciprocable axially in a valve body in a line connecting the crankcase to the engine intake manifold. The valve is moved by higher manifold vacuums to a low speed position restricting flow through the line, or at low vacuums to a fully open, high load position allowing maximum flow. Because of the manufacturing tolerance variances between engines, providing different flow characteristics and vibrations, the same ventilation valve assembly will not necessarily provide the same flow for different engines. It is important that the flow be precisely metered since it forms a position of the intake mixture flowing to the engine cylinders and a change in air/fuel ratio of even small amounts can adversely affect engine operation and emission control.

It is the primary object of this invention, therefore, to provide a PCV valve assembly that provides a continuous, precise metering of the flow of blow-by gases and vapors to the engine so as to provide a minimum variance in flow from engine to engine.

It is a futher object of the invention to provide a PCV valve assembly that includes means to establish sonic flow conditions over all of the part throttle operating range of the valve assembly to obtain a more precise metering of the flow through the valve than with known constructions.

It is a still further object of the invention to provide an engine PCV assembly that includes a valve slidable axially within a valve body between a usually seated position in which flow is at sonic velocity through one path, while flow is blocked through an alternate path, and alternate positions permitting flow also through the alternate path, and including a sonic flow metering means within the valve to flow gases and vapors through the valve at most of the time at sonic velocity so as to provide precise metering that is repeatable from engine to engine.

Other objects, features and advantages of the invention will become more apparent upon reference to the succeeding detailed description thereof, and to the drawing illustrating the preferred embodiment thereof; wherein, FIG. 1 is an end elevational view of an internal combustion engine embodying the invention;

FIG. 2 is a cross-sectional view of a prior art type PCV valve;

FIG. 3 is a chart graphically illustrating the changes in engine blow-by gas flow with changes in engine intake manifold vacuum;

FIG. 4 is a cross-sectional view of a PCV valve assembly embodying the invention; and, FIG. 5 is a chart graphically illustrating the changes in blow-by gas flow with changes in engine intake manifold vacuum for the valve assembly illustrated in FIG. 4.

FIG. 1 illustrates schematically a V-8 type internal combustion engine 10. It has an air cleaner 12 controlling the flow of clean air to the induction passage 14 of a carburetor 15. The carburetor is mounted by a flange 16 over the engine intake manifold 18. The engine per se consists of the usual pistons 20 (only one shown) reciprocable in a cylinder block 22 to draw in an air/fuel mixture from the intake manifold 18 upon operation of a valve train enclosed by a cover 24.

During operation of the engine, a variable amount of vapors and gases leak past piston 20 into the crankcase 26. To recapture these, a crankcase ventilation system is provided that directs them back into the engine intake manifold. More particularly, the carburetor flange 16 has a passage that is connected to a tube 30 connected at its opposite end through the valve cover 24 to the crankcase 26. During engine operation, ventilating air flows through a filtered opening in an oil filler cap 32 past the valve train and piston 20 into the crankcase, and therefrom into tube 30. The tube in this instance contains a PCV valve assembly 33 to continuously meter the flow to rid the engine of the blow-by gases and fumes without unduly affecting the air/fuel ratio of the mixture flowing into the engine.

As stated previously, PCV valves are well known, being shown, for example, in U.S. Pat. No. 2,716,398, McMullen, U.S. Pat. No. 2,829,629, Badertscher et al, U.S. Pat. No. 2,853,986, Kolbe, U.S. Pat. No. 2,639,701, Blaes, and U.S. Pat. No. 2,407,178, Roos. FIG. 2 shows a valve assembly that is typical of the above-recited prior art. More particularly, it shows a two-piece valve body 34 formed with a stepped internal diameter defining a valve seat 36 at one end and an orificed opening 38 at the opposite end. Cooperating with the seat and orifice is a somewhat pear-shaped "jiggle" pin 42. The pin is spring biased against the orificed end 44 of the valve body and is conically shaped at its opposite end for variable flow between the conical end and valve seat 36, in a manner to be described. The body of the jiggle pin is provided with a number of openings 48 to permit flow of blow-by gases and fumes into an annular chamber or space 49 between the jiggle pin and valve body. It is also formed at its manifold end with a constant area opening or straight hole 50 to permit some flow even when the valve is seated during low load, high manifold vacuum conditions.

With the construction as described, during engine idle operations, at high vacuum levels, the jiggle pin 42 will be drawn leftwardly as seen in FIG. 2 to seat and permit flow only through the opening 50. As the carburetor throttle valve is opened to increase air and fuel flow into the engine, decreasing manifold vacuum permits the spring to move the valve 42 rightwardly to increase flow or blow-by gases and fumes into the annular space 49 between the jiggle pin and valve body, thus providing a continuous flow in proportion to engine air flow.

It should be noted, however, that with the construction as described, with a constant area hole 50, the latter opening is subject to air flow losses below approximately 14 inches Hg. manifold vacuum levels, resulting in variable flow under part load conditions. This results in a variance in flow of blow-by gases and fumes from engine to engine and from vacuum level to vacuum level below the 14 inch Hg. level.

As stated previously, different engines provide different flow characteristics because of manufacturing tolerances providing different operating characteristics. Therefore, most automobile manufacturers require that PCV valve manufacturers provide PCV valve assemblies that will maintain flow levels between certain maximums and minimums, in order to not unduly affect the air/fuel mixture ratio. This is shown more particularly in FIG. 3 which illustrates a typical manufacturer's flow requirements over the operating span of the intake manifold vacuum.

More particularly, FIG. 3 shows that for a jiggle pin or PCV valve to be acceptable, it must provide a flow between the maximum flow curve A and the minimum flow curve B. It will be seen that the spread in air flow is almost ½ cu. ft./min. at the high manifold vacuum levels and increases to substantially a full cu. ft./min. at the lower, high load levels. This leads to imprecise metering and less accurate control of the air/fuel ratio of the mixture flowing into the engine. The effect of air flow losses at the low load end of the PCV valve is evident by the ½ cubic feet per minute allowance, and the differences in engine operating characteristics providing a change of 1 cubic foot per minute at the high load end is also indicated by the chart.

The invention provides a predictable calibration of the blow-by gas and fume flow by providing a precise metering of the flow down to vacuum levels as low as 2–3 inches Hg., which covers substantially all of the part throttle operations of the engine. More particularly, the invention provides a sonic venturi flow PCV device operable over essentially all of the part throttle operating range of the engine to provide a precise control of the flow of the blow-by gases and vapors without the flow losses associated with a constant diameter flow hole.

As seen in FIG. 4, the PCV valve assembly includes a one piece sleeve type valve body 51 having a stepped internal diameter providing a valve seat 52 at one end and defining a passage 54 of controlled area. The opposite end 56 of the valve body contains a washer-like spacer 58 defining an orifice opening 60, the spacer being held in place by a retaining ring 62. Slidably movable axially within the valve body is a metering valve 64 that has a flat end 66 to seat at times against the spacer 58. The valve has a conical shaped end 68 for cooperation with seat 52 to shut-off or permit flow through the annulus 69 between the two. A spring 70 biases the valve to seat against the spacer 58.

The valve 64 is provided with sonic flow metering means consisting of a central, axially extending round, converging, diverging (C-D) passage 72. The passage extends through the valve so as to flow blow-by gases and fumes at sonic velocity most of the time when the engine is running. More particularly, the metering valve 64 is internally shaped to define a converging passage portion 74 that merges with a diffuser or diverging passage portion 76 to define a throat section or most constricted flow area portion 78 between the two. Th geometric configuration and dimensions of the passage are such as to provide a choked mode of operation of flow at sonic velocity through the passage over all of the part throttle operating range of the engine down to 2–3 inches Hg. vacuum level.

Before proceeding to the operation, it should be noted that the force of spring 70 is chosen such that in this case it will, at the precise moment that flow through the passage 72 changes from sonic to subsonic, i.e., around 2–4 inches Hg. vacuum, begin moving the valve 64 rightwardly off seat 52. This then permits additional flow through the alternate path defined through chamber 69, as well as through the C-D passage 72. The flow then will be modulated, at first as controlled by the space between the conical end 68 and the valve seat 52, and subsequently, when valve 64 moves further rightwardly, by the size of orifice 60 and the number of flutes or shape of the end 66 of valve 64, after the conical end no longer plays a part in the modulation.

It will be clear, of course, that the point at which the force of spring 70 is sufficient to move valve 64 rightwardly off seat 52 can be altered as desired to suit engine ventilation requirements. In some cases for instance, the valve might start moving rightwardly at a vacuum level of say 4 inches Hg., when the flow through passage 72 is still sonic, because high flow volumes may be desired.

In operation, therefore, with the engine running and the throttle valve in closed position, i.e., the engine idling, the intake manifold vacuum will be at a level exceeding 15 inches Hg., which is higher than the chosen force of spring 70, to move the regulating valve 64 leftwardly as seen in FIG. 4 to seat against seat 52. This will close off all flow of blow-by gases and fumes through the outer annulus 69 defined between the valve 64 and valve body 51 and force all flow through the sonic flow nozzle defined by the passage 72. Accordingly, the flow will be at sonic velocity wherein the flow is independent of downstream pressure variations and is, therefore, constant. The nozzle is flowing at its capacity at sonic velocity. Being a constant rate of flow, it provides an exact measurement of the flow and, therefore, permits a quite accurate control of bypass gases and consequently, to the overall control of the air/fuel ratio of the mixture flowing into the engine cylinders. This is phase one.

As the carburetor throttle valve is opened, intake manifold vacuum decreases to a point where the force of spring 70 begins moving the valve 64 rightwardly and the transition begins from sonic flow to subsonic. Flow now occurs not only through the sonic passage 72, which at this point may or may not be sonic depending upon the spring force chosen, but also through the annulus 69 between the valve and valve body. This is phase two, the unchoked flow modulating position. With the flow through annulus 69 unchoked or subsonic, then the flow varies as a function of the pressure drop across the orifice or opening between the conical end 68 and the shoulder 52. Phase three occurs when valve 64 moves rightwardly far enough to change control of the flow from the conical end of the valve to the other end. That is, when the pressure differential at the conical end disappears, then flow is controlled by the pressure differential across the space between the end 66 of valve 64 and the orifice 60.

The level at which the flow remains sonic or not will, of course, depend upon the valve end configuration (round or spoked, etc.,) and the inner diameter of spacer 58 and outer diameter of valve 64. The valve 64 thus regulates or modulates between the one position seated against seat 52, and the opposite position adjacent the spacer 58, the positions varying as a function of the manifold vacuum level. A backfire position fully seated against the spacer 58 is also obtained when the pressure in the passage 54 suddenly rises above that in the orifice 60.

FIG. 5 graphically illustrates the constantness of the flow of blow-by gases with the construction provided in FIG. 4, down to low intake manifold vacuum levels, followed by the subsequent flow modulation. More specifically, the curve 82, for example, illustrates a constant flow rate down to 2½ inches Hg., or over all of the part throttle operating range, with the construction as seen in FIG. 4, by virtue of the sonic flow through the passage 72. It shows an increased flow below that vacuum level by the additional modulated flow first controlled through the space 69 between the valve and the valve body, and then through the space between the valve body end 66 and spacer 58.

As stated above, by changing the valve configuration and valve assembly parts dimensions, the flow curves can be altered during modulated flow operation. By changing the diameter of sonic passage 72, flow also can be altered during sonic operation. The curves 84, 86 and 88 illustrate the changing flow patterns at the high load ends of the curves due to progressively increasing the outer diameter of valve 64 and the orifice size or internal diameter of the spacer 58, curve 88 showing the greatest flow rate for both a large internal diameter of spacer 58 and a large external diameter of the valve.

From the above, therefore, it will be seen that the invention provides a PCV valve assembly that provides very precise metering of the flow of blow-by gases and fumes from the engine crankcase into the engine intake manifold, and thereby enables the designer to accurately control the air/fuel ratio of the mixture flowing into the engine from the carburetor so as to provide accurate emission control. It will also be seen that the invention provides a continuous flow of blow-by gases tailored to control the air/fuel ratio of the mixture flowing into the engine in a very precise manner so that the flow is repeatable from engine to engine and unaffected by variances in engine operating characteristics.

While the invention has been shown and described in the preferred embodiments, it will be clear to those skilled in the arts to which it pertains that many changes and modifications may be made thereto without departing from the scope of the invention.

We claim:

1. An engine positive crankcase ventilation valve assembly for use in a line connecting the engine crankcase to the engine intake manifold, comprising, a sleeve type valve body having a valve seat formed on its internal diameter and slidably receiving a regulating valve of lesser diameter therein to define a flow annulus therebetween, the valve being axially movable against and away from the valve seat in response to manifold vacuum acting thereon to control variably the flow of crankcase vapors and gases to the intake manifold through the annulus, spring means biasing the valve towards a fully open position away from the valve seat in opposition to manifold vacuum acting on the valve to close the valve, and sonic flow control means extending through the valve to permit at least a minimum flow at a constant rate through the valve during all partial load conditions to always maintain a predetermined constant rate of flow of vapors and gases to the intake manifold.

2. An assembly as in claim 1, the control means comprising a sonic flow inducing passage extending centrally through the valve along its axis in a manner to connect the opposite ends of the valve at all times.

3. An assembly as in claim 1, the control means comprising a convergent-divergent passage extending axially through the valve from end-to-end so constructed and arranged as to maintain sonic velocity to flow therethrough at all part throttle operating vacuum levels.

4. An assembly as in claim 1, including a heavy load flow capacity orifice defined by means mounted in the valve body adjacent the end of the valve opposite the valve end cooperating with the seat, the spring means biasing the valve towards the latter means at times to provide flow through the annulus in addition to flow through the control means.

5. An engine positive crankcase ventilation valve assembly for use in a line connecting the engine vapors and gases from the engine crankcase to the engine intake manifold, comprising, a cylindrical open ended sleeve-type valve body having a stepped internal diameter defining a valve seat near one end, an annular washer-like spacer mounted within the valve body at the other end and having an opening defining a flow restricting orifice, an essentially cylindrical regulating valve variably slidably movable within the valve body and having an outside diameter less than the internal diameter of the valve body to define a flow annulus between, the valve being movable between a first position against the valve seat blocking flow therepast between the valve and seat and a second position adjacent the spacer regulating flow from the orifice to the annulus, the valve being tapered at one end for cooperation with the valve seat to variably modulate flow through the space between the valve and seat as a function of movement of the valve, spring means biasing the valve against the spacer, and an sonic flow passage extending centrally through the valve along its axis from end-to-end for communicating crankcase gases and vapors to the intake manifold during all part load operations, the passage providing a constant volume of flow during all partial load operations when the valve is seated against the valve seat and providing a modulated flow in response to movement of the valve to positions inbetween the first and second positions in response to changes in the intake manifold vacuum level.

6. An assembly as in claim 5, wherein the sonic flow passage is defined by a convergent-divergent nozzle constructed and arranged to provide sonic velocity to flow therethrough for all manifold vacuum force levels greater than an engine wide open throttle level of operation.

* * * * *